US011417945B2

(12) United States Patent
Kasani

(10) Patent No.: US 11,417,945 B2
(45) Date of Patent: Aug. 16, 2022

(54) BASE STATION ANTENNAS HAVING LOW COST SHEET METAL CROSS-DIPOLE RADIATING ELEMENTS

(71) Applicant: CommScope Technologies LLC, Hickory, NC (US)

(72) Inventor: Kumara Swamy Kasani, Godavari Khani (IN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/236,098

(22) Filed: Apr. 21, 2021

(65) Prior Publication Data

US 2021/0359395 A1 Nov. 18, 2021

Related U.S. Application Data

(60) Provisional application No. 63/023,382, filed on May 12, 2020.

(51) Int. Cl.

| | |
|---|---|
| ***H01Q 21/26*** | (2006.01) |
| ***H01Q 1/24*** | (2006.01) |
| ***H01Q 21/00*** | (2006.01) |
| ***H01Q 19/10*** | (2006.01) |
| ***H01Q 21/06*** | (2006.01) |
| *H01Q 5/385* | (2015.01) |
| *H01Q 1/12* | (2006.01) |

(52) U.S. Cl.

CPC ..... *H01Q 1/246* (2013.01); *H01Q 19/108* (2013.01); *H01Q 21/0075* (2013.01); *H01Q 21/062* (2013.01); *H01Q 21/26* (2013.01); *H01Q 1/1228* (2013.01); *H01Q 5/385* (2015.01)

(58) Field of Classification Search

CPC .. H01Q 1/246; H01Q 19/108; H01Q 21/0075; H01Q 21/062; H01Q 21/26; H01Q 5/385; H01Q 1/1228

See application file for complete search history.

(56) References Cited

U.S. PATENT DOCUMENTS 6,924,776 B2 8/2005 Le et al.
2020/0373671 A1* 11/2020 Li ..... H01Q 19/108

* cited by examiner

*Primary Examiner* — Joseph J Lauture
(74) *Attorney, Agent, or Firm* — Myers Bigel, P.A.

(57) ABSTRACT

A cross-dipole radiating element includes a first dipole radiator that has a first dipole arm assembly that includes a first stalk and a first dipole arm that extends from the first stalk and a second dipole arm assembly that includes a second stalk and a second dipole arm that extends from the second stalk, as well as a second dipole radiator that has a third dipole arm assembly that includes a third stalk and a third dipole arm that extends from the third stalk and a fourth dipole arm assembly that includes a fourth stalk and a fourth dipole arm that extends from the fourth stalk. The first and second stalks form a first microstrip transmission line and the third and fourth stalks form a second microstrip transmission line. The first and second microstrip transmission lines directly feed the respective first and second dipole radiators.

20 Claims, 10 Drawing Sheets

BASE STATION ANTENNAS HAVING LOW COST SHEET METAL CROSS-DIPOLE RADIATING ELEMENTS

CROSS-REFERENCE TO RELATED APPLICATION

The present application claims priority under 35 U.S.C. § 119 to U.S. Provisional Patent Application Ser. No. 63/023,382, filed May 12, 2020, the entire content of which is incorporated herein by reference.

BACKGROUND

The present invention generally relates to radio communications and, more particularly, to radiating elements for base station antennas used in cellular communications systems.

Cellular communications systems are well known in the art. In a cellular communications system, a geographic area is divided into a series of regions that are referred to as "cells" which are served by respective base stations. The base station may include one or more base station antennas that are configured to provide two-way radio frequency ("RF") communications with mobile subscribers that are within the cell served by the base station. In many cases, each base station is divided into "sectors." In perhaps the most common configuration, a hexagonally shaped-cell is divided into three 120° sectors, and each sector is served by one or more base station antennas that have an azimuth Half Power Beamwidth (HPBW) of approximately 65°. Typically, the base station antennas are mounted on a tower or other raised structure, with the radiation patterns (also referred to herein as "antenna beams") that are generated by the base station antennas directed outwardly. Base station antennas are often implemented as linear or planar phased arrays of radiating elements.

In order to accommodate the ever-increasing volume of cellular communications, cellular operators have added cellular service in a variety of new frequency bands. Cellular operators have applied a variety of approaches to support service in these new frequency bands, including deploying linear arrays of "wide-band" radiating elements that provide service in multiple frequency bands, and/or deploying multiband base station antennas that include multiple linear arrays (or planar arrays) of radiating elements that support service in different frequency bands. One very common multiband base station antenna design includes one linear array of "low-band" radiating elements that are used to provide service in some or all of the 694-960 MHz frequency band and two linear arrays of "high-band" radiating elements that are used to provide service in some or all of the 1427-2690 MHz frequency band. These linear arrays are mounted in side-by-side fashion.

SUMMARY

Pursuant to embodiments of the present invention, base station antennas are provided that include a reflector and a cross-dipole radiating element that extends forwardly from the reflector. The cross-dipole radiating element comprises a first dipole radiator and a second dipole radiator. The first dipole radiator has a first dipole arm assembly that includes a first forwardly-extending stalk and a first dipole arm extending at a first angle from the first forwardly-extending stalk and a second dipole arm assembly that includes a second forwardly-extending stalk and a second dipole arm extending at a second angle from the second forwardly-extending stalk. The second dipole radiator has a third dipole arm assembly that includes a third forwardly-extending stalk and a third dipole arm extending at a third angle from the third forwardly-extending stalk and a fourth dipole arm assembly that includes a fourth forwardly-extending stalk and a fourth dipole arm extending at a fourth angle from the fourth forwardly-extending stalk. The first through fourth dipole arm assemblies each comprise sheet metal assemblies. The first and second stalks form a first microstrip transmission line and the third and fourth stalks form a second microstrip transmission line.

In some embodiments, the first and second microstrip transmission lines may be air microstrip transmission lines.

In some embodiments, a width of the second dipole arm may be greater than a width of the first dipole arm.

In some embodiments, all four of the first through fourth dipole arms may be direct fed by the respective first through fourth stalks.

In some embodiments, the base station antenna may further include a cross-shaped director that is mounted forwardly of the first through fourth dipole arms.

In some embodiments, the third dipole arm may include a recess and the first dipole arm may extend through the recess. In some embodiments, the recess may be the interior of a generally U-shaped section in the third dipole arm. In some embodiments, a width of each segment that is part of the U-shaped section portion of the third dipole arm may be less than a width of another section of the third dipole arm.

In some embodiments, the first and third stalks may each include a hole that is configured to receive a center conductor of a respective coaxial cable.

In some embodiments, the base station antenna may further include a first dielectric support that includes a base and first and second projections that extend forwardly from the base, where the first projection supports the first and second stalks and the second projection supports the third and fourth stalks.

In some embodiments, the first dipole arm may be shaped differently from the second dipole arm, the third dipole arm may be shaped differently from the fourth dipole arm, and the second dipole arm may be shaped the same as the fourth dipole arm.

Pursuant to further embodiments of the present invention, base station antennas are provided that include a reflector and a cross-dipole radiating element that extends forwardly from the reflector. The cross-dipole radiating element comprises a first dipole radiator having a first dipole arm and a second dipole arm and a second dipole radiator having a third dipole arm and a fourth dipole arm. The third dipole arm includes a recess, and the first dipole arm extends through the recess.

In some embodiments, the third dipole arm may include a U-shaped section, and the recess may be the interior of the U-shaped section.

In some embodiments, the first dipole arm may be shaped differently from the second dipole arm.

In some embodiments, the third dipole arm may be shaped differently from the fourth dipole arm.

In some embodiments, the second dipole arm may be shaped the same as the fourth dipole arm.

In some embodiments, the first dipole arm may be part of a first dipole arm assembly that also includes a first forwardly-extending stalk, the second dipole arm may be part of a second dipole arm assembly that also includes a second forwardly-extending stalk, the third dipole arm may be part of a third dipole arm assembly that also includes a third forwardly-extending stalk, and the fourth dipole arm may be part of a fourth dipole arm assembly that also includes a fourth forwardly-extending stalk.

In some embodiments, a width of the second stalk may be greater than a width of the first stalk.

In some embodiments, the first and second stalks may form a first microstrip transmission line and the third and fourth stalks may form a second microstrip transmission line.

In some embodiments, the first through fourth dipole arm assemblies each may be sheet metal assemblies.

In some embodiments, a width of each segment that is part of the U-shaped section portion of the third dipole arm may be less than a width of another section of the third dipole arm.

Pursuant to still further embodiments of the present invention, base station antennas are provided that include a reflector and a cross-dipole radiating element that extends forwardly from the reflector. The cross-dipole radiating element comprises a first dipole radiator and a second dipole radiator. The a first dipole radiator has a first dipole arm assembly that includes a first forwardly-extending stalk and a first dipole arm extending from the first forwardly-extending stalk and a second dipole arm assembly that includes a second forwardly-extending stalk and a second dipole arm extending from the second forwardly-extending stalk. The second dipole radiator has a third dipole arm assembly that includes a third forwardly-extending stalk and a third dipole arm extending from the third forwardly-extending stalk and a fourth dipole arm assembly that includes a fourth forwardly-extending stalk and a fourth dipole arm extending from the fourth forwardly-extending stalk. The first dipole arm crosses the third dipole arm when the cross-dipole radiating element is viewed from the front.

In some embodiments, the first dipole arm may extend in a first plane, the third dipole arm may extend in a third plane that is perpendicular to the first plane, and the intersection of the first and third planes may define a first axis that is perpendicular to the reflector.

In some embodiments, the first dipole arm may be on both sides of the first axis in the first plane, and the third dipole arm may be on both sides of the first axis in the third plane.

In some embodiments, the second dipole arm may extend in a second plane, the fourth dipole arm may extend in a fourth plane that is perpendicular to the second plane, and the intersection of the second and fourth planes may define a second axis that is perpendicular to the reflector.

In some embodiments, the second dipole arm may be only on one side of the second axis in the second plane, and the fourth dipole arm may be only on one side of the second axis in the fourth plane.

DETAILED DESCRIPTION

Figure 1A:
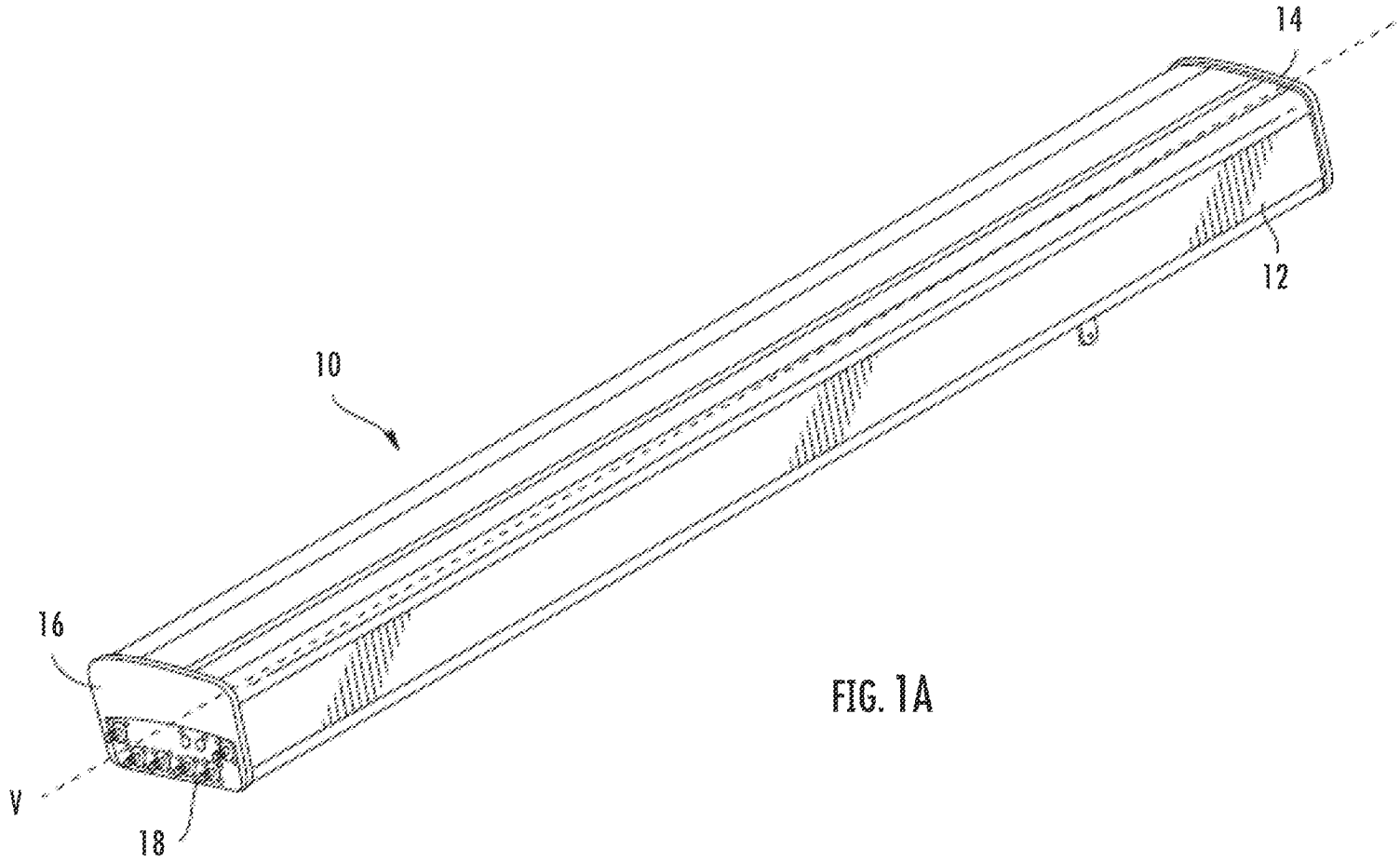
FIG. 1A is a side perspective view of a base station antenna according to embodiments of the present invention.

Pursuant to embodiments of the present invention, base station antennas are provided that include cross-dipole radiating elements are provided that may be inexpensive to manufacture and assemble, reasonably small, and which may support a relatively wide operating bandwidth. The radiating elements according to embodiments of the present invention may be formed of stamped sheet metal and may be mounted on a reflector of an antenna by screws, rivets or other conventional fasteners. Coaxial feed cables may be directly connected to the radiating elements in some embodiments, eliminating the need for separate feed boards. The radiating elements disclosed herein may be used in multiband base station antennas.

The cross-dipole radiating elements according to embodiments of the present invention include a first dipole radiator that directly radiates RF signals at a +45° polarization and a second dipole radiator that directly radiates RF signals at a −45° polarization. The first dipole radiator comprises a first dipole arm assembly that includes a first stalk and a first dipole arm that extends from the first stalk and a second dipole arm assembly that includes a second stalk and a second dipole arm that extends from the second stalk. The second dipole radiator similarly comprises a third dipole arm assembly that includes a third stalk and a third dipole arm that extends from the third stalk and a fourth dipole arm assembly that includes a fourth stalk and a fourth dipole arm that extends from the fourth stalk. The first and second stalks form a first microstrip transmission line and the third and fourth stalks form a second microstrip transmission line. The first and second microstrip transmission lines may directly feed the respective first and second dipole radiators.

In some embodiments, the third dipole arm includes a recess, and the first dipole arm extends through the recess. For example, the third dipole arm may include a U-shaped section, and the recess may be the interior of the U-shaped section.

According to further embodiments of the present invention, base station antenna are provided that a cross-dipole radiating element that extends forwardly from a reflector. The cross-dipole radiating element includes a first dipole radiator having a first dipole arm assembly that includes a first forwardly-extending stalk and a first dipole arm extending from the first forwardly-extending stalk and a second dipole arm assembly that includes a second forwardly-extending stalk and a second dipole arm extending from the second forwardly-extending stalk, and a second dipole radiator having a third dipole arm assembly that includes a third forwardly-extending stalk and a third dipole arm extending from the third forwardly-extending stalk and a fourth dipole arm assembly that includes a fourth forwardly-extending stalk and a fourth dipole arm extending from the fourth forwardly-extending stalk. The first dipole arm crosses the third dipole arm when the cross-dipole radiating element is viewed from the front.

In these embodiments the first dipole arm may extend in a first plane and the third dipole arm may extend in a third plane that is perpendicular to the first plane. The intersection of the first and third planes may define a first axis that is perpendicular to the reflector that extends through the center of the cross-dipole radiating element. The second dipole arm extends in a second plane and the fourth dipole arm extends in a fourth plane that is perpendicular to the second plane. The intersection of the second and fourth planes defines a second axis that is perpendicular to the reflector. The first dipole arm is on both sides of the first axis in the first plane, and the third dipole arm is on both sides of the first axis in the second plane. In contrast, the second dipole arm is only on one side of the second axis in the second plane, and the fourth dipole arm is only on one side of the second axis in the fourth plane.

The above-described radiating elements may be formed primarily from stamped sheet metal in some embodiments, which allows these radiating elements to be fabricated at very low cost. One or more dielectric (e.g., plastic) supports may be provided that are used to structurally support the dipole arm assemblies. A director may be mounted forwardly of the dipole arms using, for example, one of the dielectric supports as a mounting structure for the director. Since the first through fourth stalks of the respective first through fourth dipole arm assembles are used to form the first and second RF transmission lines that feed RF signals to and from the respective first and second dipole radiators, the radiating element may have a very simple design with a small number of parts.

In some embodiments, the first and second microstrip transmission lines that feed the respective first and second dipole radiators may comprise air microstrip transmission lines. In some embodiments, a width of the second dipole arm may be greater than a width of the first dipole arm, and/or a width of the third dipole arm may be greater than a width of the fourth dipole arm.

Embodiments of the present invention will now be discussed in greater detail with reference to the accompanying figures.

Figure 1B:
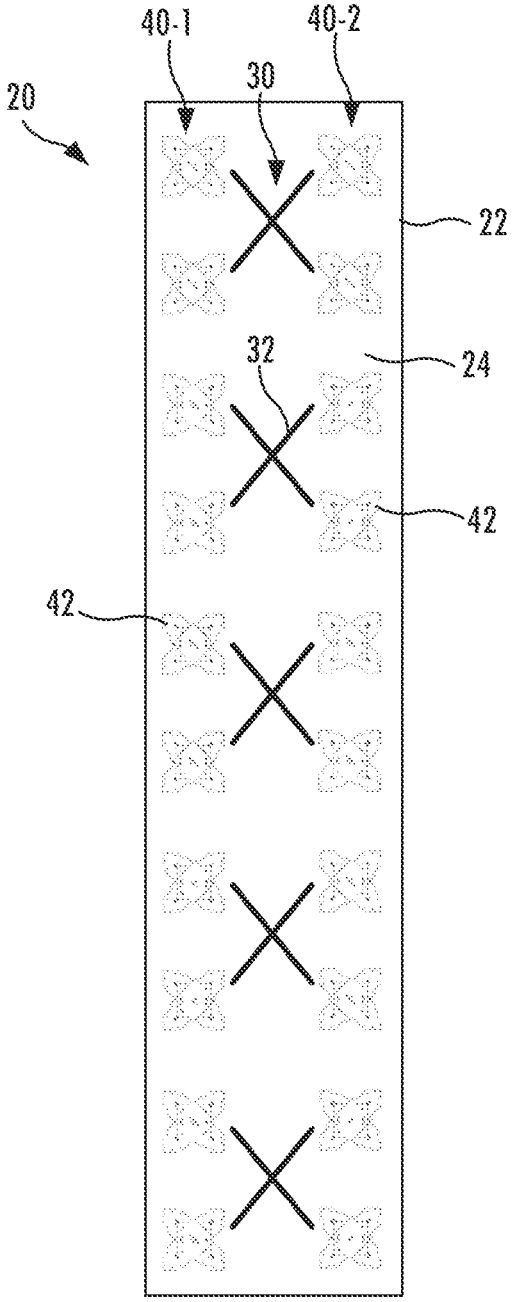
FIG. 1B is a schematic front view of the base station antenna of FIG. 1A with the radome removed.
Figure 1C:
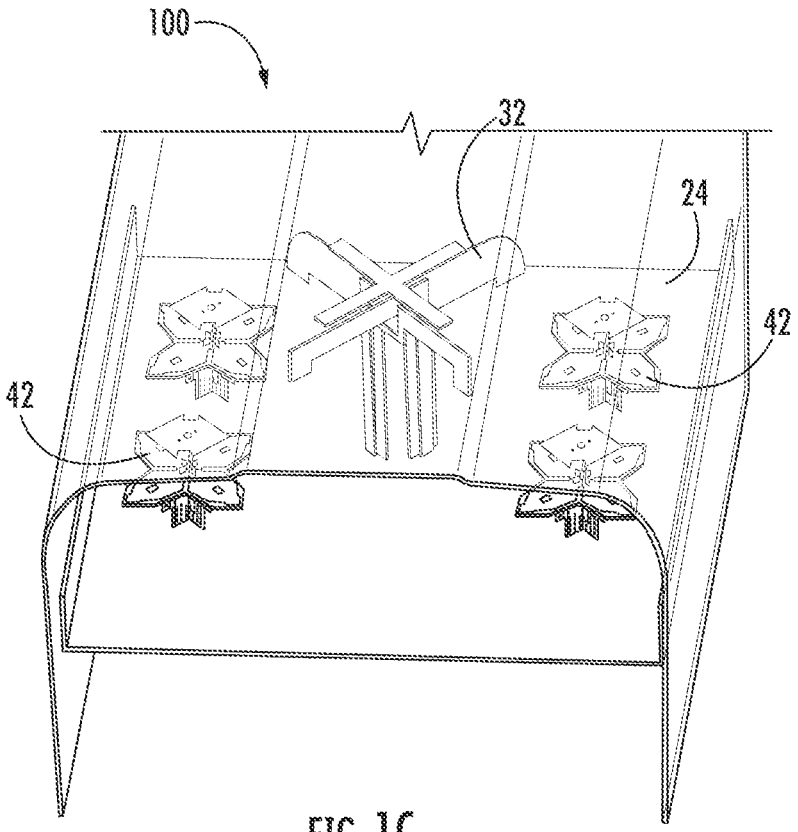
FIG. 1C is a shadow front perspective view of a portion of the base station antenna of FIG. 1A.
Figure 1D:
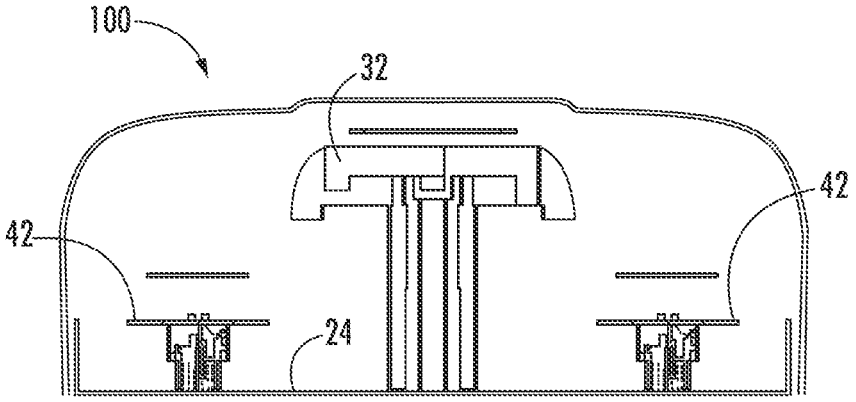
FIG. 1D is top view of the reflector and radiating elements of the base station antenna of FIG. 1A.

FIGS. 1A through 1D illustrate a base station antenna 10 according to certain embodiments of the present invention. In particular, FIG. 1A is a schematic front perspective view of the base station antenna 10, FIG. 1B is a front view of the antenna 10 with the radome thereof removed to illustrate the inner components of the antenna, FIG. 1C is a shadow front perspective view of a portion of the base station antenna 10, and FIG. 1D is top view of the reflector and radiating elements of the base station antenna 10.

As shown in FIG. 1A, the base station antenna 10 is an elongated structure that extends along a longitudinal axis V. The base station antenna 10 may have a tubular shape with generally rectangular cross-section. The antenna 10 includes a radome 12 and a top end cap 14, which may or may not be integral with the radome 12. The antenna 10 also includes a bottom end cap 16 which includes a plurality of connectors 18 mounted therein. The antenna 10 is typically mounted in a vertical configuration (i.e., the longitudinal axis V may be generally perpendicular to a plane defined by the horizon when the antenna 10 is mounted for normal operation).

As shown in FIGS. 1B-1D, the base station antenna 10 includes an antenna assembly 20 that may be slidably inserted into the radome 12. The antenna assembly 20 includes a ground plane structure 22 that has a reflector 24. Various mechanical and electronic components of the antenna (not shown) may be mounted behind the reflector 24 such as, for example, phase shifters, remote electronic tilt ("RET") units, mechanical linkages, a controller, diplexers, and the like. The reflector 24 may comprise or include a metallic surface that serves as both a reflector and as a ground plane for the radiating elements of the antenna 10.

A plurality of low-band radiating elements 32 and a plurality of high-band radiating elements 42 are mounted to extend forwardly from the reflector 24. As shown in FIG. 1B, the low-band radiating elements 32 are mounted in a vertical column to form a linear array 30 of low-band radiating elements 32, and the high-band radiating elements 42 are mounted in two vertical columns to form two linear arrays 40-1, 40-2 of high-band radiating elements 42. The linear array 30 of low-band radiating elements 32 may be positioned between the two linear arrays 40-1, 40-2 of high-band radiating elements 42. Each linear array 30, 40-1, 40-2 may be used to form a pair of antenna beams, namely a first antenna beam having a +45° polarization and a second antenna beam having a −45° polarization. Note that herein when multiple like elements are provided, the elements may be identified by two-part reference numerals. The full reference numeral (e.g., linear array 40-2) may be used to refer to an individual element, while the first portion of the reference numeral (e.g., the linear arrays 40) may be used to refer to the elements collectively.

The low-band radiating elements 32 may be configured to transmit and receive RF signals in a first frequency band. In some embodiments, the first frequency band may comprise the 694-960 MHz frequency range or a portion thereof. The high-band radiating elements 42 may be configured to transmit and receive signals in a second frequency band. In some embodiments, the second frequency band may comprise the 1427-2690 MHz frequency range or a portion thereof. It will be appreciated that the number of linear arrays of radiating elements may be varied from what is shown in FIG. 1B, as may the number of radiating elements per linear array and/or the positions of the linear arrays.

As noted above, embodiments of the present invention provide low cost radiating elements that may be used, for example, to implement each of the low-band radiating elements 32 shown in FIGS. 1B-1D. A first embodiment of such a cross-dipole radiating element 100 will now be described with reference to FIGS. 2A-2B, which are schematic side perspective views of the cross-dipole radiating element 100. FIGS. 3A-3D are schematic side views of the dipole arm assemblies 120-1 through 120-4, respectively, of cross-dipole radiating element 100.

Figure 2A:
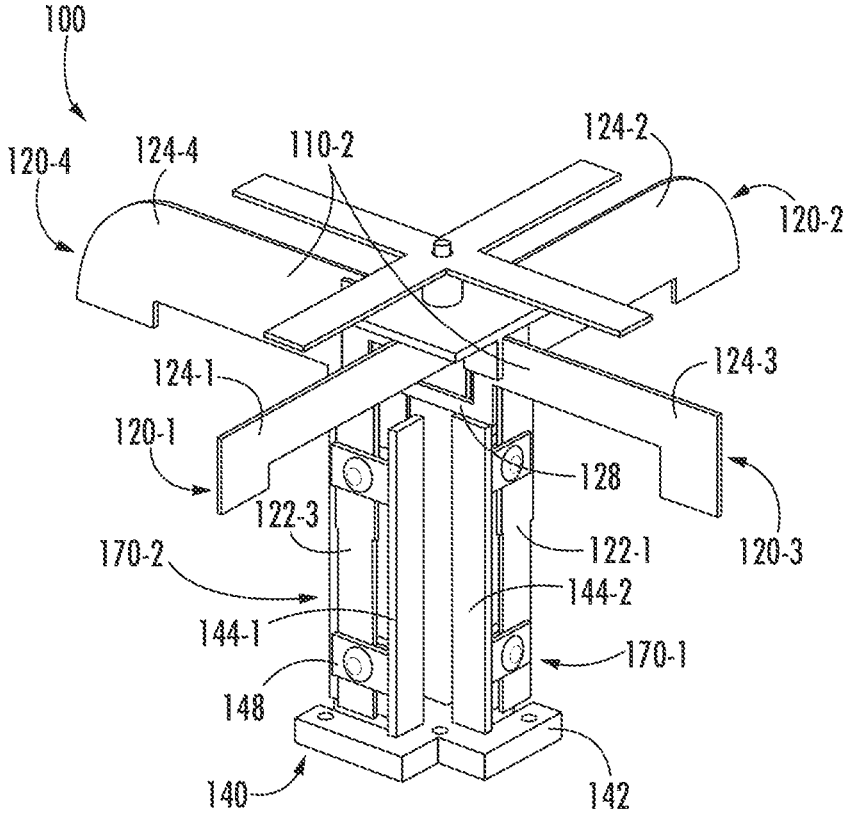
FIGS. 2A and 2B are side perspective views of a cross-dipole radiating element that may be used in the base station antenna of FIGS. 1A-1D.
Figure 2B:
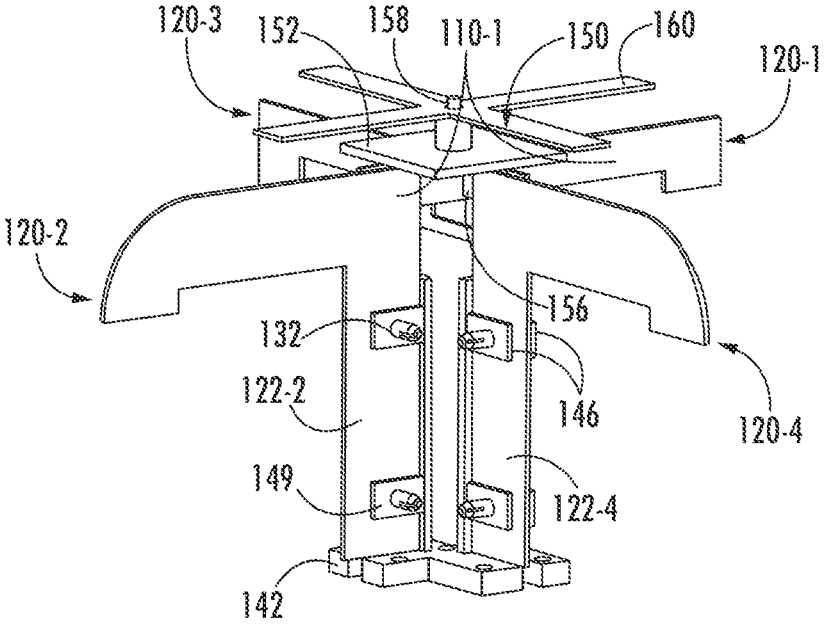

As shown in FIGS. 2A-2B, the cross-dipole radiating element 100 includes first and second dipole radiators 110-1, 110-2, which are arranged (when viewed from the front) so the dipole arms thereof generally form a cruciform shape. The first dipole radiator 110-1 includes first and second dipole arm assemblies 120-1, 120-2, and the second dipole radiator 110-2 includes third and fourth dipole arm assemblies 120-3, 120-4. FIGS. 3A-3D are schematic side views of dipole arm assemblies 120-1 through 120-4, respectively.

The radiating element 100 further includes a rear dielectric support 140 and a front dielectric support 150 and a director 160.

The first dipole arm assembly 120-1 includes a first forwardly-extending stalk 122-1 and a first dipole arm 124-1 that extends at a first angle from the first forwardly-extending stalk 122-1. The second dipole arm assembly 120-2 includes a second forwardly-extending stalk 122-2 and a second dipole arm 124-2 that extends at a second angle from the second forwardly-extending stalk 122-2. The third dipole arm assembly 120-3 includes a third forwardly-extending stalk 122-3 and a third dipole arm 124-3 that extends at a third angle from the third forwardly-extending stalk 122-3. The fourth dipole arm assembly 120-4 includes a fourth forwardly-extending stalk 122-4 and a fourth dipole arm 124-4 that extends at a fourth angle from the fourth forwardly-extending stalk 122-4. In the depicted embodiment, the first through fourth angles are each approximately 90°, although embodiments of the invention are not limited thereto. In an example embodiment, the dipole arm assemblies 120 may be formed from sheet metal that is, for example, 0.5-1.2 mm thick (e.g., 0.8 mm thick). The sheet metal may comprise, for example, aluminum or copper.

Figure 3A:
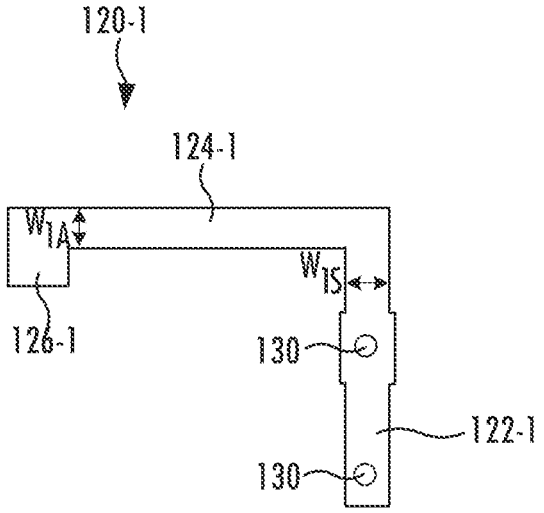
FIGS. 3A-3D are schematic side views of the four respective dipole arm assemblies that are included in the cross-dipole radiating element of FIGS. 2A-2B.
Figure 3B:
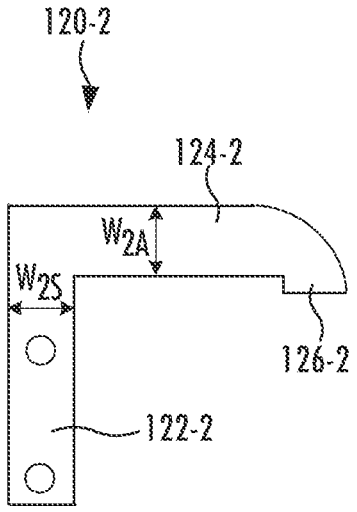

Referring to FIGS. 3A and 3B, the first dipole arm assembly 120-1 may be generally L-shaped. A distal end of the first dipole arm 124-1 may have a rearwardly-extending projection 126-1. The rearwardly-extending projection may increase the electrical length of dipole arm 126-1 without increasing the physical length of the dipole arm 124-1 when the dipole arm 124-1 is viewed from the front. Dipole arms 124-2 through 124-4 may similarly include respective projections 126-2 through 126-4 at the distal ends thereof. The second dipole arm assembly 120-2 may also have a shape that is close to an L-shape. In the depicted embodiment, the second stalk 122-2 of the second dipole arm assembly 120-2 has a width $W_{2S}$ that is greater than a width $W_{1S}$ of the first stalk 122-1 of the first dipole arm assembly 120-1. This may improve the performance of a first microstrip transmission line 170-1 that is formed by the first and second stalks 122-1, 122-2, as discussed in greater detail below. The second dipole arm 124-2 of the second dipole arm assembly 120-2 has a width $W_{2A}$ that is greater than a width $W_{1A}$ of the first dipole arm 124-1 of the first dipole arm assembly 120-1. Additionally, the distal end of the second dipole arm 124-2 has a rounded transition to the protrusion 126-2, while the first dipole arm 124-1 has a 90° angle transition to the protrusion 126-1.

Note that herein the "length" of a dipole arm or a stalk refers to how far the dipole arm or stalk extends along its longitudinal (longest) dimension. The "width" of a dipole arm or stalk refers to how far the dipole arm or stalk extends in a second dimension that is perpendicular to the longitudinal dimension, where the second dimension is within the plane defined by the planar dipole arm or stalk structure. The "thickness" of a dipole arm or stalk refers to the thickness of the metal from which the dipole arm or stalk is stamped.

Figure 3C:
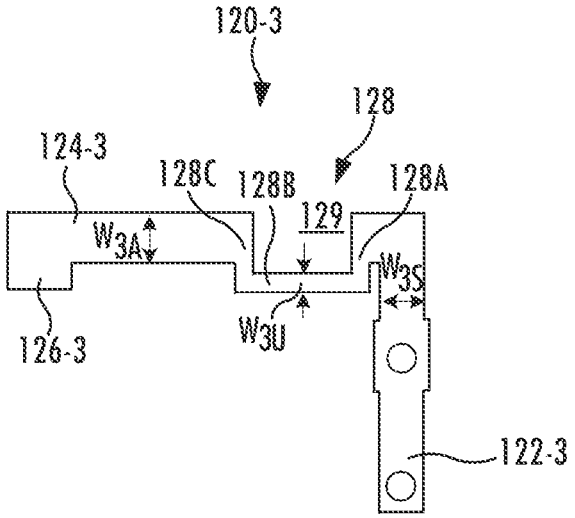
Figure 3D:
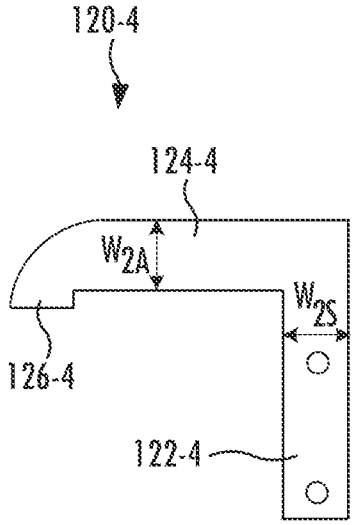

Referring to FIGS. 3C and 3D, the third dipole arm assembly 120-3 may also be generally L-shaped, and may be similar to the first dipole arm 124-1. The third dipole arm assembly 120-3, however, includes a U-shaped section 128 at or adjacent the base thereof. The U-shaped section 128 may comprise a rearwardly-extending conductive segment 128A, a transversely-extending conductive segment 128B and a forwardly-extending conductive segment 128C that together define a recess 129. The first dipole arm 124-1 extends through the recess 129 so that the first and third dipole arms 124-1, 124-3 may cross each other when viewed from the front without electrically contacting each other. At least one of the first through third conductive segments 128A-128C that form the U-shaped section 128 may have a width $W_{3U}$ that is less than the width $W_{3A}$ of the remainder of the first dipole arm 124-1. The fourth dipole arm assembly 120-4 also has an L-shape and may be identical to the second dipole arm 124-2. Accordingly, the fourth stalk 122-4 has a width $W_{2S}$ that is greater than a width $W_{3S}$ of the third stalk 122-3, and the fourth dipole arm 124-4 has a width $W_{2A}$ that is greater than a width $W_{3A}$ of the distal portion of the third dipole arm 124-3 arm that extends outwardly from the U-shaped section 128.

As shown in FIGS. 2A-2B, the first stalk 122-1 and the second stalk 122-2 are positioned directly adjacent each other and extend forwardly in parallel in spaced-apart fashion. As will be discussed in further detail below, the first stalk 122-1 may be directly connected to a center conductor of a first coaxial feed cable and the second stalk 122-2 may be directly connected to the ground (outer) conductor of the first coaxial feed cable. As such the first stalk 122-1 and the second stalk 122-2 together form a first microstrip transmission line 170-1 that passes RF signals between the first coaxial feed cable and the first dipole radiator 110-1. Likewise, the third stalk 122-3 and the fourth stalk 122-4 are positioned directly adjacent each other and extend forwardly in parallel in spaced-apart fashion. The third stalk 122-3 may be directly connected to a center conductor of a second coaxial feed cable and the fourth stalk 122-4 may be directly connected to the ground (outer) conductor of the second coaxial feed cable. As such the third stalk 122-3 and the fourth stalk 122-4 together form a second microstrip transmission line 170-2 that passes RF signals between the second coaxial feed cable and the second dipole radiator 110-2.

As shown best in FIGS. 3A-3D, each dipole arm assembly 120 may include a pair of openings 130 in the stalk 122 thereof. The openings 130 in the first stalk 122-1 may be aligned with the openings 130 in the second stalk 122-2, and the openings 130 in the third stalk 122-3 may be aligned with the openings 130 in the fourth stalk 122-4 when the radiating element 100 is assembled.

Referring again to FIGS. 2A-2B, the rear dielectric support 140 may comprise, for example, a plastic support that may be formed, for example, via injection molding. The rear dielectric support 140 includes a base 142 and first and second forwardly extending support arms 144-1, 144-2. Support arm 144-1 includes first and second pairs 146-1, 146-2 of tabs 148, where the tabs 148 of each pair 146-1, 146-2 extend parallel to each other in spaced-apart fashion. Likewise, support arm 144-2 includes third and fourth pairs 146-3, 146-4 of tabs 148, where the tabs 148 of each pair 146-3, 146-4 extend parallel to each other in spaced-apart fashion. The first and second stalks 122-1, 122-2 are captured between the first and second pairs 146-1, 146-2 of tabs 148, and the third and fourth stalks 122-3, 122-4 are captured between the third and fourth pairs 146-3, 146-4 of tabs 148.

The tabs 148 of the first and second pairs 146-1, 146-2 of tabs 148 each include openings 149 such as circular holes. These holes 149 in the tabs 148 of the first and second pairs 146-1, 146-2 of tabs 148 are aligned with the openings 130 in the first and second stalks 122-1, 122-2 when the radiating element 100 is assembled. The tabs 148 of the third and fourth pairs 146-3, 146-4 of tabs 148 also each include openings (e.g. holes) 149. These holes 149 in the tabs 148 of the third and fourth pairs 146-3, 146-4 of tabs 148 are aligned with the openings 130 in the third and fourth stalks 122-3, 122-4 when the radiating element 100 is assembled. Plastic rivets 132 or other dielectric spacers are inserted through the openings 130 and 149 in order to mount the first and second stalks 122-1, 122-2 in a parallel, spaced-apart relationship in order to form the first microstrip transmission line 170-1, and to mount the third and fourth stalks 122-3, 122-4 in a parallel, spaced-apart relationship in order to form the second microstrip transmission line 170-2.

Figure 4:
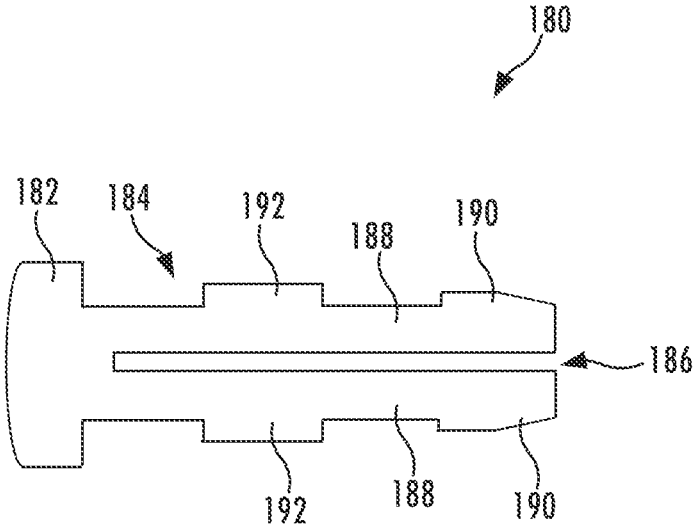
FIG. 4 is a side view of a plastic rivet that may is used in the cross-dipole radiating element of FIGS. 2A-2B

FIG. 4 is a schematic side view of a plastic rivet 180 that may be used to implement the plastic rivets 132. As shown in FIG. 4, the plastic rivet 180 includes a head 182 and a shaft 184. A slot 186 may extend through the shaft 184 to divide the shaft into multiple arms 188 (the embodiment of FIG. 4 includes two arms 188). Tabs 190 are provided on or near the distal end of each arm 188. Each arm 188 includes an enlarged central region 192. The distal ends of the arm 188 may be compressed together so that the tabs 190 may be inserted through the openings 130 in the first and second stalks 122-1, 122-2 and through the openings 149 in the tabs 148 of the first support arm 144-1. The openings 130 in the first stalk 122-1 and in the tabs 148 that are adjacent the first stalk 122-1 may be larger than the openings 130, 149 in the second stalk 122-2 and in the tabs 148 that are adjacent the second stalk 122-2. This design allows the enlarged central portion 192 of each arm 188 of each rivet 180 to extend through the respective openings 130 in the first stalk 122-1 and the openings 149 in the tabs 148 that are adjacent the first stalk 122-1, while preventing the enlarged central portion 192 of each arm 188 of each rivet 180 to extend through the respective openings 130 in the second stalk 122-2 and the openings 149 in the tabs 148 that are adjacent the second stalk 122-2. As such, the enlarged central portions 192 of arms 188 may be between the first and second stalks 122-1, 122-2 and may space the first stalk 122-1 a predetermined distance apart from the second stalk 122-2 so that the first microstrip transmission line 170-1 may have desired or predetermined impedance.

The openings 149 in the third and fourth pairs 146-3, 146-4 of tabs and the openings 130 in the third and fourth stalks 122-3, 122-4 may be designed identically as described above with respect to the first and second pairs 146-1, 146-2 of tabs and the first and second stalks 122-1, 122-2 so that the second microstrip transmission line 170-2 may also have desired or predetermined impedance.

Referring again to FIGS. 2A-2B, the front dielectric support 150 may also comprise, for example, a plastic support that may be formed via injection molding. The front dielectric support 150 includes a base 152, first through fourth of pairs of spaced-apart tabs 156 that extend rearwardly from the base 152, a projection 158 that extends forwardly from the base 152. The and first and second forwardly extending support arms 144-1, 144-2. Each of the pairs of tabs 156 may capture an edge of a respective one of the dipole arms 124 therebetween so that each of the dipole arms 124 are held in a proper position and/or so that proper spacing may be maintained between adjacent dipole arms 124. The projection 158 may be used as a mounting location for a director 160 that is mounted forwardly of the dipole arms 124. The director 160 may be used to narrow the beamwidth of a radiation pattern of the radiating element 100. The director 160 may comprise, for example, a planar piece of stamped metal. In the depicted embodiment, director 160 has a cruciform-shape, with each arm of the cruciform extending in parallel with and in front of a respective one of the dipole arms 124.

As discussed above, the first through fourth stalks 122-1 through 122-4 form a pair of microstrip transmission lines 170-1, 170-2. In the depicted embodiment, these microstrip transmission lines 170 are air microstrip transmission lines as the two stalks 122 that form each transmission line 170 are separated by an air dielectric (along with the plastic rivets 132, but, the dielectric is mostly air). In other embodiments, a different dielectric may be used.

Figure 5:
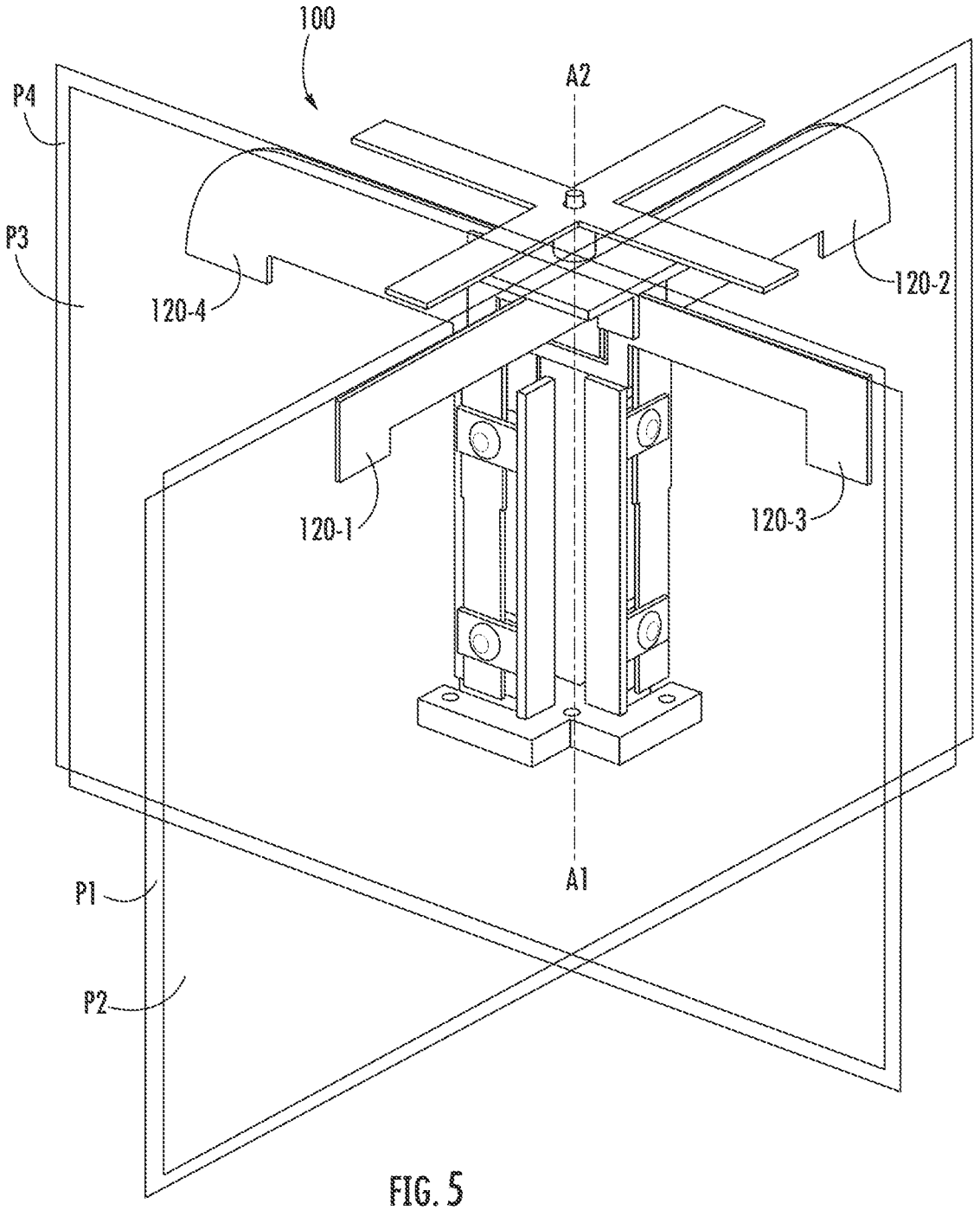
FIG. 5 is a side perspective view of a cross-dipole radiating element of FIGS. 2A-2B that illustrates various planes and axes defined by the dipole arm assemblies thereof.
Figure 6:
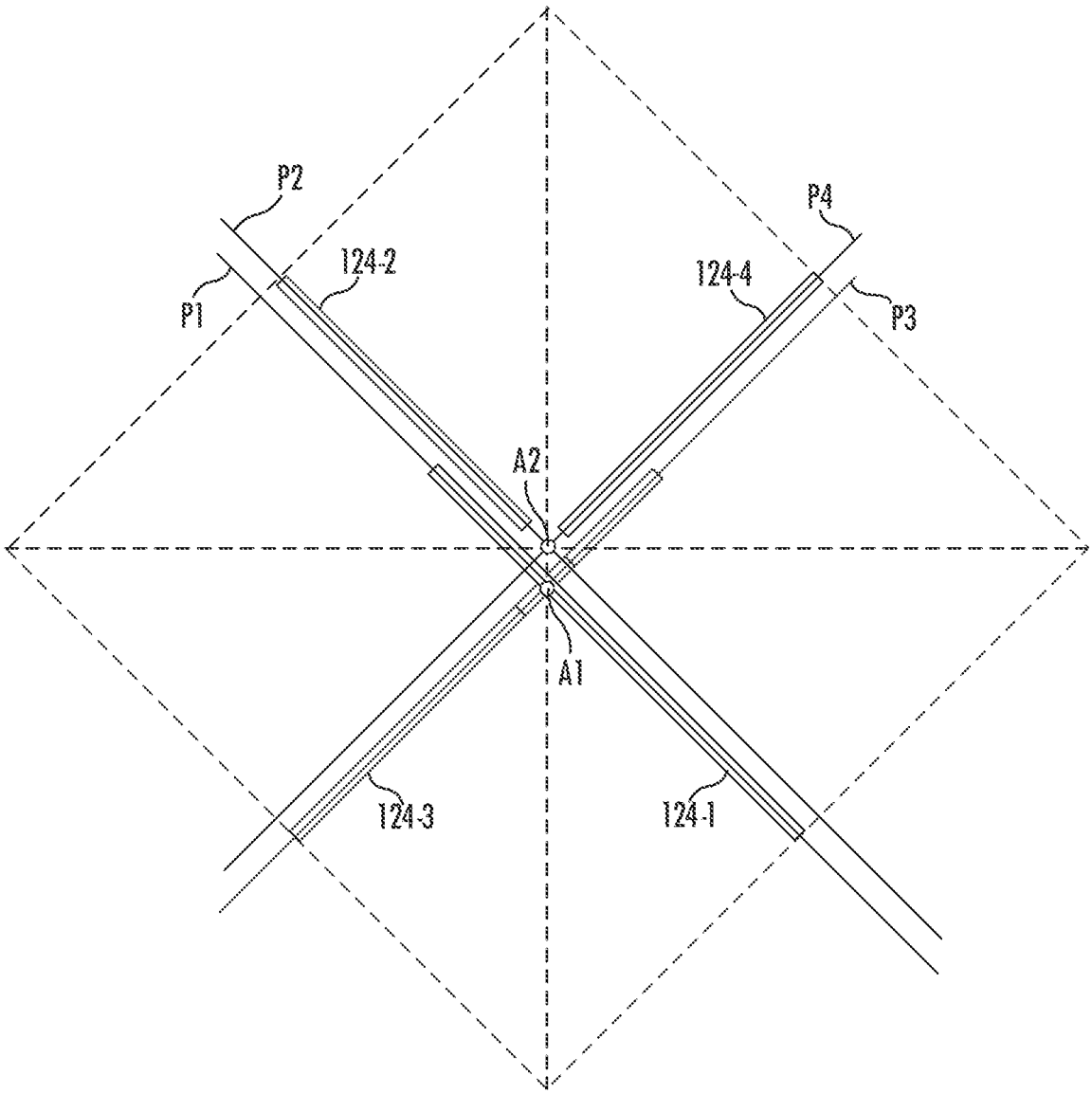
FIG. 6 is a schematic front view of the dipole arms of the cross-dipole radiating element of FIGS. 2A-2B that illustrates the relative locations of the stalks and dipole arms with respect to the center of the radiating element.

FIG. 5 is a side perspective view of the cross-dipole radiating element 100 that illustrates various planes and axes defined by the dipole arm assemblies thereof. FIG. 6 is a schematic front view of the dipole arms 124 of the cross-dipole radiating element 100 that illustrates the relative locations of the stalks 122 and dipole arms 124 with respect to the center of the radiating element and with respect to the planes and axes shown in FIG. 5. In FIG. 6, a dashed box is drawn around the radiating element as well as a pair of dashed lines that connect the opposed corners of the box. The intersection of the dashed lines is at the center of the radiating element 100.

As shown in FIG. 5, four planes P1-P4 may be defined. As can be seen in FIG. 5, plane P1 extends through the middle of the thickness of the first dipole arm assembly 120-1, plane P2 extends through the middle of the thickness of the second dipole arm assembly 120-2, plane P3 extends through the middle of the thickness of the third dipole arm assembly 120-3, and plane P4 extends through the middle of the thickness of the fourth dipole arm assembly 120-4. Planes P1 and P2 are parallel planes that are separated by the separation distance between the conductors (namely the first and second stalks 122-1, 122-2) of the first microstrip transmission line 170-1, and planes P3 and P4 are parallel planes that are separated by the separation distance between the conductors (namely the third and fourth stalks 122-3, 122-4) of the second microstrip transmission line 170-2.

As can be seen from FIGS. 5 and 6, the first and third planes P1, P3 extend perpendicular to each other, and the intersection of the first and third planes P1, P3 defines a first axis A1. The axis A1 may extend perpendicularly to the reflector 24 of the base station antenna (see FIG. 1B) in which radiating element 100 is mounted. As can also be seen from FIGS. 5-6, the first dipole arm 124-1 is on both sides of the first axis A1 in the first plane P1, and the third dipole arm 124-3 is on both sides of the first axis A1 in the third plane P3. Similarly, the second and fourth planes P2, P4 extend perpendicular to each other, and the intersection of the second and fourth planes P2, P4 defines a second axis A2. The second axis may also be perpendicular to the reflector when the radiating element 100 is mounted for use. The second dipole arm 124-2 is only on one side of the second axis A2 in the second plane P2, and the fourth dipole arm 124-4 is only on one side of the second axis A2 in the fourth plane P4.

Figure 7A:
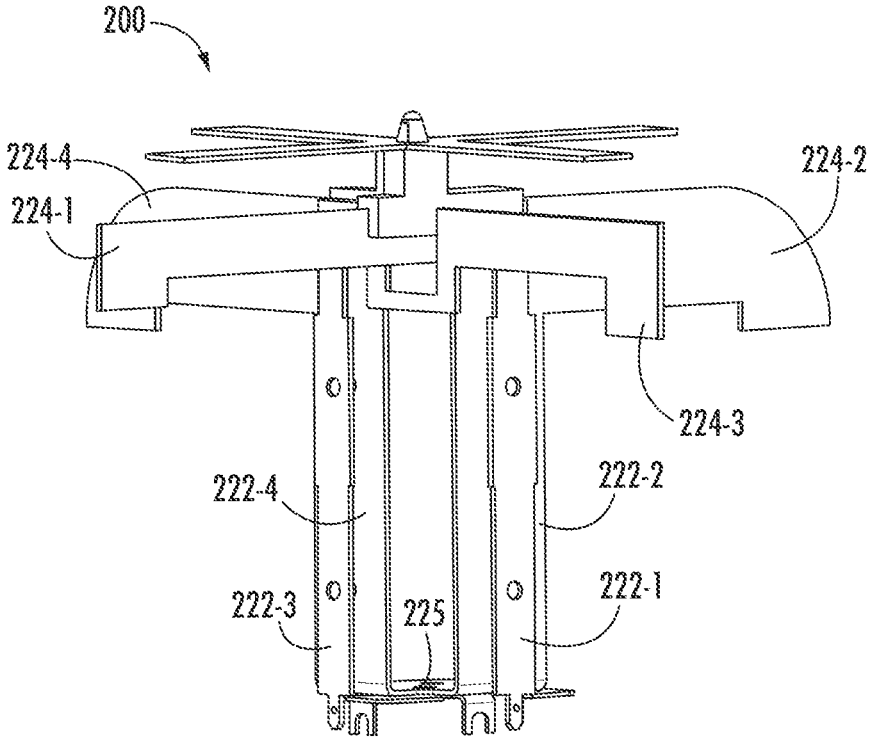
FIG. 7A is a side perspective view of a low-band radiating element according to further embodiments of the present invention.
Figure 7B:
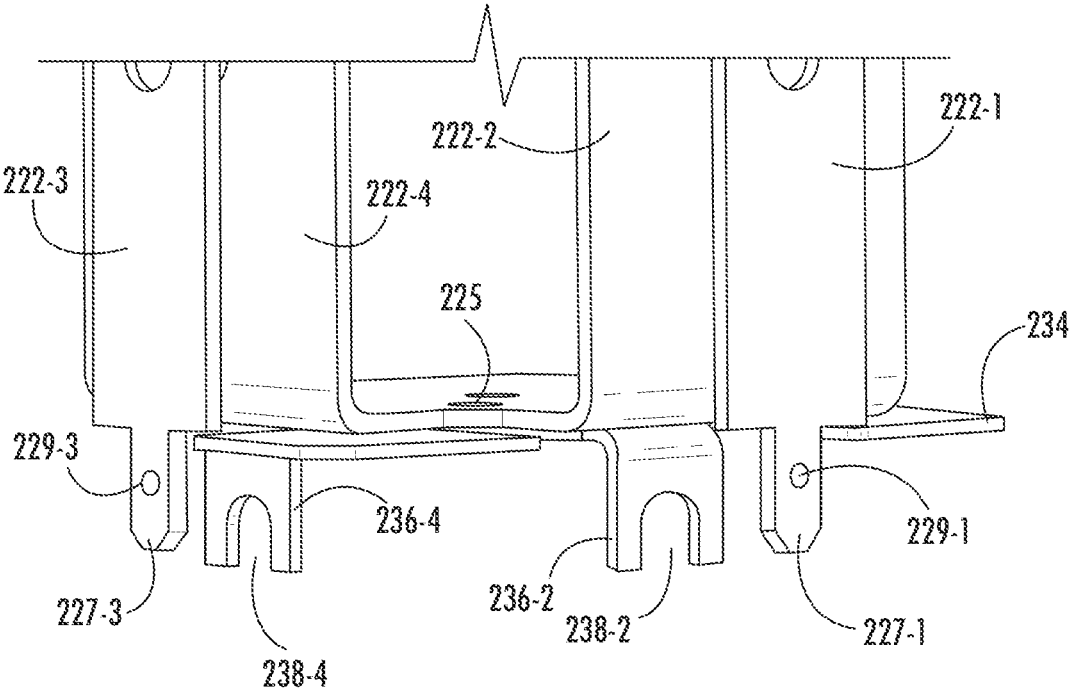
FIG. 7B is an enlarged partial perspective of a rear portion of the radiating element of FIG. 7A.

FIGS. 7A and 7B are a side perspective view and an enlarged partial perspective view of a radiating element 200 according to further embodiments of the present invention. FIGS. 7A and 7B illustrate one possible mechanism for connecting the radiating element 200 to a feed network of the base station antenna. The radiating element 100 described above with reference to FIGS. 2A-6 does not show any particular mechanism for attaching the radiating element 100 to a feed network to emphasize that a wide variety of mechanisms may be used for electrically coupling the radiating elements according to embodiments of the present invention to a feed network. These mechanisms include, for example, direct galvanic connections such as soldered connections and/or capacitive connections.

As can be seen by comparing FIGS. 2A-3D to FIGS. 7A-7B, the radiating elements 100 and 200 differ in three primary ways. First, the second and fourth dipole arm assemblies 220-2, 220-4 of radiating element 200 are formed from a single piece of sheet metal as opposed to being formed from two separate pieces of metal as was the case with the second and fourth dipole arm assemblies 120-2, 120-4 of radiating element 100. Consequently, a connecting plate 225 connects the base of dipole arm assembly 220-2 to the base of dipole arm assembly 220-4. Second, the first and third stalks 222-1, 222-3 of radiating element 200 include respective rearward extensions 227-1, 227-3 that include respective circular openings 229-1, 229-3 therein. The center conductor of a first coaxial feed cable (not shown) may be inserted through the opening 229-1 and soldered in place, and the center conductor of a second coaxial feed cable (not shown) may be inserted through the opening 229-3 and soldered in place. Third, radiating element 200 includes a mounting plate 234 that is not included in radiating element 100. The mounting plate 234 may comprise a mostly flat plate that includes first and second rearward extensions 236-2, 236-4 that may be bent at 90° angles from the remainder of the mounting plate 234. Each rearward extension 236-2, 236-4 includes a respective U-shaped cutout 238-2, 238-4 therein. The outer conductor of the first coaxial feed cable (not shown) may be inserted into the U-shaped cutout 238-2 and soldered in place, and the outer conductor of the second coaxial feed cable (not shown) may be inserted into the U-shaped cutout 238-4 and soldered in place. The mounting plate may be galvanically or capacitively connected to the connecting plate 225. Thus, the embodiment of FIGS. 7A-7B illustrates one possible way that the radiating elements according to embodiments of the present invention could be coupled to a feed network of a base station antenna.

Figure 8A:
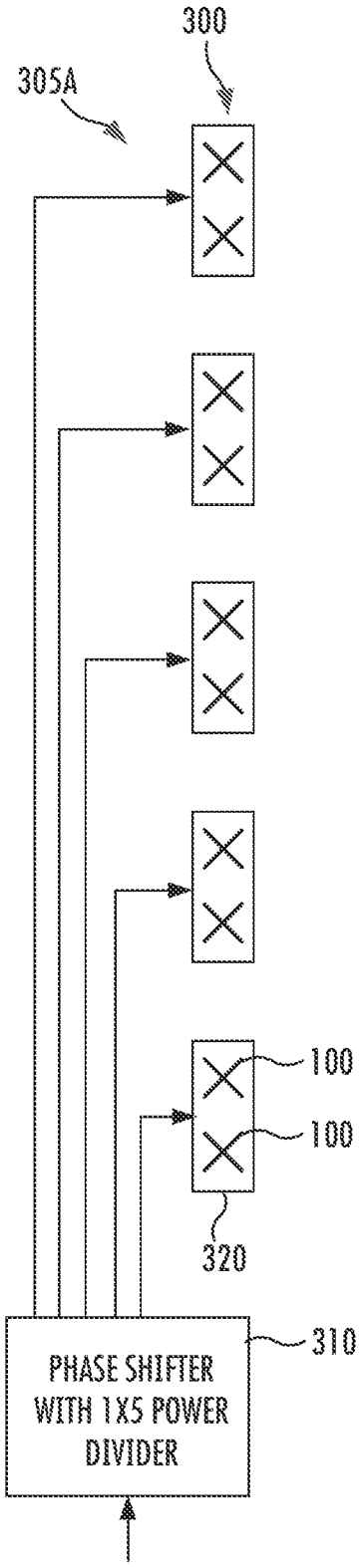
FIGS. 8A-8C are block diagrams of three possible feed networks for the low-band array of the base station antenna of FIGS. 1A-1D.
Figure 8B:
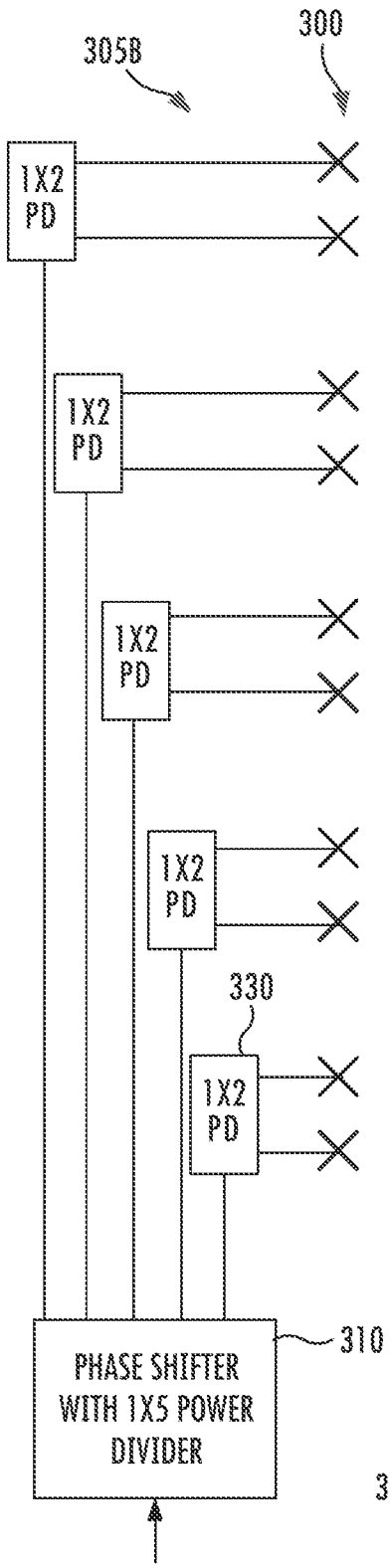
Figure 8C:
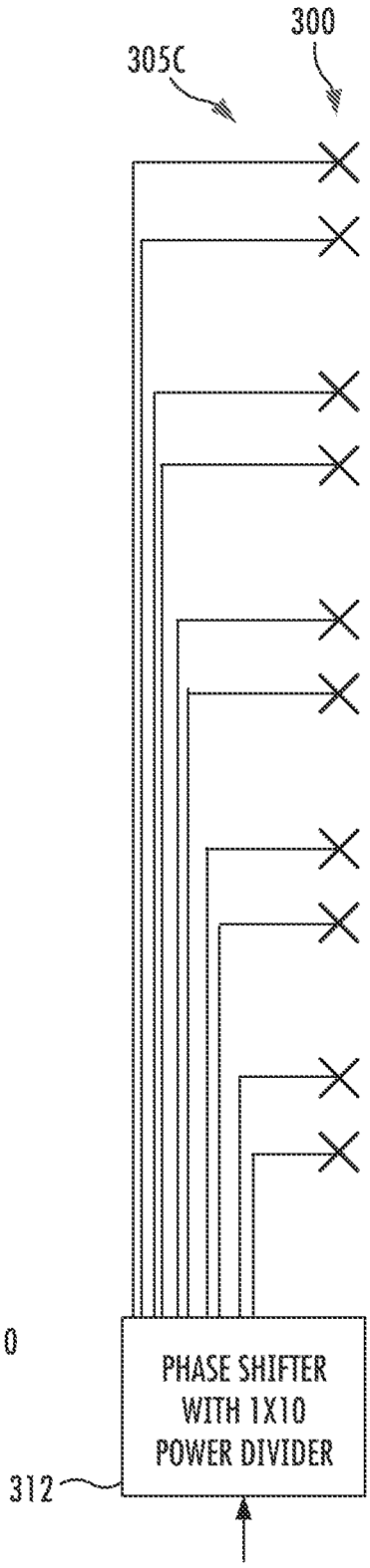

FIGS. 8A-8C are block diagrams of three possible feed networks 305A-305C for an array 300 of the cross-dipole radiating elements 100 according to embodiments of the present invention that includes a total of ten radiating elements. The block diagrams of FIGS. 8A-8C only show the feed network for the dipole radiators 110-4 of each radiating element 100. It will be appreciated that each feed network 305A-305C will include another set of the exact same components (e phase shifter, power dividers) for the dipole radiators 110-2 having the other polarization.

In the embodiment of FIG. 8A, an RF signal may be input to a phase shifter 310 that includes an integrated 1×5 power divider. The 1×5 power divider may divide the input RF signal into five sub-components and the phase shifter 310 may apply a phase taper to the five sub-components to apply an electronic tilt to the antenna beam generated by the dipole radiators 110-1 of array 300 in a manner well known to those of skill in the art. The five sub-components of the RF signal are then passed via RF transmission lines (e.g., coaxial feed cables) to five respective feed boards 320, which may each comprise microstrip printed circuit boards having 1×2 power dividers and transmission lines formed therein. Each feed board 320 has two of the radiating elements 100 mounted thereon. The respective sub-components of the RF signal that are provided to each feed board 320 are split by the respective 1×2 power dividers on each feed board 320 and fed to the respective radiating elements 110 on the feed board 320.

The embodiment of FIG. 8B is similar to the embodiment of FIG. 8A, except that the feed boards 320 are omitted in the feed network 305B and instead five 1×2 power dividers 330 are provided. Each 1×2 power divider 330 splits the sub-component of the RF signal input thereto into two parts and those further split sub-components may then be passed to respective individual radiating elements 100 by, for example, coaxial feed cables.

The embodiment of FIG. 8C is similar to the embodiment of FIG. 8A, except that the feed boards 320 are omitted in the feed network 305B and instead the phase shifter includes a 1×10 power divider as opposed to a 1×5 power divider. For example, the five power dividers 330 included in feed network 305B can be incorporated into the phase shifter 312 of feed network 305C. This allows a total of ten coaxial feed cables to be used to connect the phase shifter 312 to the ten radiating elements 100.

The cross-dipole radiating elements according to embodiments of the present invention may be inexpensive to manufacture and simple to assemble.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A base station antenna, comprising:

a reflector; and a cross-dipole radiating element extending forwardly from the reflector, the cross-dipole radiating element comprising:

a first dipole radiator having a first dipole arm assembly that includes a first forwardly-extending stalk and a first dipole arm extending at a first angle from the first forwardly-extending stalk and a second dipole arm assembly that includes a second forwardly-extending stalk and a second dipole arm extending at a second angle from the second forwardly-extending stalk; and a second dipole radiator having a third dipole arm assembly that includes a third forwardly-extending stalk and a third dipole arm extending at a third angle from the third forwardly-extending stalk and a fourth dipole arm assembly that includes a fourth forwardly-extending stalk and a fourth dipole arm extending at a fourth angle from the fourth forwardly-extending stalk, wherein the first through fourth dipole arm assemblies each comprise sheet metal assemblies, and wherein the first and second stalks form a first microstrip transmission line and the third and fourth stalks form a second microstrip transmission line.

2. The base station antenna of claim 1, wherein the first and second microstrip transmission lines comprise air microstrip transmission lines.

3. The base station antenna of claim 1, wherein a width of the second dipole arm is greater than a width of the first dipole arm.

4. The base station antenna of claim 1, wherein all four of the first through fourth dipole arms are direct fed by the respective first through fourth stalks.

5. The base station antenna of claim 1, further comprising a cross-shaped director that is mounted forwardly of the first through fourth dipole arms.

6. The base station antenna of claim 1, wherein the third dipole arm includes a recess and the first dipole arm extends through the recess.

7. The base station antenna of claim 6, wherein the recess is the interior of a generally U-shaped section in the third dipole arm.

8. The base station antenna of claim 7, wherein a width of each segment that is part of the U-shaped section portion of the third dipole arm is less than a width of another section of the third dipole arm.

9. The base station antenna of claim 1, wherein the first and third stalks each include a hole that is configured to receive a center conductor of a respective coaxial cable.

10. The base station antenna of claim 1, wherein the first dipole arm is shaped differently from the second dipole arm, the third dipole arm is shaped differently from the fourth dipole arm, and the second dipole arm is shaped the same as the fourth dipole arm.

11. A base station antenna, comprising:

a reflector; and a cross-dipole radiating element extending forwardly from the reflector, the cross-dipole radiating element comprising:

a first dipole radiator having a first dipole arm and a second dipole arm;

a second dipole radiator having a third dipole arm and a fourth dipole arm;

wherein the third dipole arm includes a recess, wherein the third dipole arm includes a U-shaped section, and the recess comprises the interior of the U-shaped section, and the first dipole arm extends through the recess; and wherein the third dipole arm includes a U-shaped section, and the recess comprises the interior of the U-shaped section.

12. The base station antenna of claim 11, wherein the first dipole arm is shaped differently from the second dipole arm.

13. The base station antenna of claim 12, wherein the third dipole arm is shaped differently from the fourth dipole arm.

14. The base station antenna of claim 13, wherein the second dipole arm is shaped the same as the fourth dipole arm.

15. The base station antenna of claim 11, wherein a width of each segment that is part of the U-shaped section portion of the third dipole arm is less than a width of another section of the third dipole arm.

16. A base station antenna, comprising:

a reflector; and a cross-dipole radiating element extending forwardly from the reflector, the cross-dipole radiating element comprising:

a first dipole radiator having a first dipole arm assembly that includes a first forwardly-extending stalk and a first dipole arm extending from the first forwardly-extending stalk and a second dipole arm assembly that includes a second forwardly-extending stalk and a second dipole arm extending from the second forwardly-extending stalk; and a second dipole radiator having a third dipole arm assembly that includes a third forwardly-extending stalk and a third dipole arm extending from the third forwardly-extending stalk and a fourth dipole arm assembly that includes a fourth forwardly-extending stalk and a fourth dipole arm extending from the fourth forwardly-extending stalk, wherein the first dipole arm crosses the third dipole arm when the cross-dipole radiating element is viewed from the front.

17. The base station antenna of claim 16, wherein the first dipole arm extends in a first plane, the third dipole arm extends in a third plane that is perpendicular to the first plane, and the intersection of the first and third planes defines a first axis that is perpendicular to the reflector.

18. The base station antenna of claim 17, wherein the first dipole arm is on both sides of the first axis in the first plane, and the third dipole arm is on both sides of the first axis in the third plane.

19. The base station antenna of claim 18, wherein the second dipole arm extends in a second plane, the fourth dipole arm extends in a fourth plane that is perpendicular to the second plane, and the intersection of the second and fourth planes defines a second axis that is perpendicular to the reflector.

20. The base station antenna of claim 19, wherein the second dipole arm is only on one side of the second axis in the second plane, and the fourth dipole arm is only on one side of the second axis in the fourth plane.

* * * * *